United States Patent [19]

Norris

[11] 4,253,202

[45] Mar. 3, 1981

[54] AUTOMATIC ADJUSTING WAVE GUTTER FOR SWIMMING POOLS

[76] Inventor: Forbes Norris, 118 Great Circle Dr., Mill Valley, Calif. 94941

[21] Appl. No.: 65,497

[22] Filed: Aug. 10, 1979

Related U.S. Application Data

[63] Continuation of Ser. No. 891,669, Mar. 30, 1978, abandoned.

[51] Int. Cl.[3] ..... E04H 3/18; E02B 7/40

[52] U.S. Cl. ..... 4/497; 4/512; 405/28; 405/100

[58] Field of Search ..... 4/172, 172.19, 172.13, 4/172.15–172.17, 172.21, 172.18, 488, 490, 491, 494, 496, 497, 505, 506, 507, 508, 510–513, 514; 114/126, 219, 240 B; 405/25, 26, 28, 100; 248/214

[56] References Cited

U.S. PATENT DOCUMENTS

| | | | |
|---|---|---|---|
| 226,772 | 4/1880 | Mueller | 405/28 |
| 1,264,112 | 4/1918 | Marpole | 114/204 B |
| 3,011,178 | 12/1961 | Stone | 4/172.18 |
| 3,011,316 | 12/1961 | Wilson | 405/28 |
| 3,214,916 | 11/1965 | Martin | 405/28 |
| 3,316,934 | 5/1967 | Sowers | 405/100 X |
| 3,333,423 | 8/1967 | Cook, Jr. | 405/100 |
| 3,562,823 | 2/1971 | Köster | 4/172.16 |
| 3,668,713 | 6/1972 | Baker | 4/172.17 |
| 3,815,161 | 6/1974 | Baker | 4/172.17 |
| 3,851,476 | 12/1974 | Edwards | 405/25 |

FOREIGN PATENT DOCUMENTS

| | | | |
|---|---|---|---|
| 608489 | 9/1960 | Italy | 405/25 |

*Primary Examiner*—Stuart S. Levy
*Attorney, Agent, or Firm*—Townsend and Townsend

[57] ABSTRACT

A wave gutter for swimming pools that automatically positions and maintains a longitudinal edge of the gutter, relative to the waterline, for optimum control of waves and other surface disturbances created by persons in the pool includes a wall member, fabricated to be buoyant in water, that is hingedly attached to a sidewall of the pool. The wall member is free to pivot about an axis that is proximate to and parallel with one of a pair of longitudinal edges of the wall member. This freedom, together with the buoyancy of the wall member, allows the other longitudinal edge to be situated substantially at the waterline for the most efficient wave damping capability.

4 Claims, 6 Drawing Figures

AUTOMATIC ADJUSTING WAVE GUTTER FOR SWIMMING POOLS

This is a Continuation of application Ser. No. 891,669, filed Mar. 30, 1978, now abandoned.

BACKGROUND AND SUMMARY OF THE INVENTION

For many swimmers, swimming in turbulent waters is not an altogether enjoyable experience. Surface disturbances of the water require the swimmer to position his head higher than normal for a breath of air in order to avoid inhaling water. This, in turn, causes the swimmer's feet to be situated deeper in the water. The end result is that the swimmer assumes an attitude which causes him or her to quickly tire. If the swimmer is just learning to swim, surface disturbances can impede progress in learning because of the swimmer's attempts to avoid getting water in the nose or mouth. Moreover, reducing waves and other surface disturbances in a pool also reduces the amount of water lost from the pool by splashing over its coping or edge.

Presently, one method of dissipating surface disturbances in pools includes the use of a drain gutter. Drain gutters usually have a vertically disposed lip that circumscribes the water in the pool, at the surface level. Wave action and other surface disturbances, generated by people in the pool, are reduced by extracting energy from the wave impinging upon the gutter when the wave breaks over the gutter lip and into the gutter. If the wave is sufficiently small, so that it does not fill the gutter, the whole of the energy in the wave is absorbed or trapped by the gutter itself. However, if the wave is sufficiently large, the secondary waves (e.g., waves that are reflected after impinging upon the coping wall) will re-enter the pool but only after undergoing a further energy loss due to reflection from the coping wall and overcoming the gutter lip to re-enter the pool.

It has been found that wave gutters are most effective when the uppermost location of the edge of the gutter lip is substantially at the water level of the pool. Wave dissipation efficiency of the gutter lip decreases when water levels are set above or below this edge. Accordingly, many of the larger or olympic-sized pools, built especially for racing, usually combine such wave gutters with extra large pumping apparatus and plumbing arrangements in order to adjust the water level within the gutter rapidly for optimum wave reduction by the gutters. Unfortunately, such wave control is very expensive and, therefore, usually omitted from modern home and club pools in favor of a much smaller and less expensive drain system that is also used for trapping leaves and other floating debris.

It is believed that efficient wave reduction does not depend to any great extent upon the profile and dimensions of the gutter. Rather, the single common denominator among competition pools using such wave gutters effectively has been the presence of a rigid water-confronting lip and the positioning of the uppermost edge of the lip at the waterline. Thus, variations in gutter profile, from square, rectangular, to curved in varying degree, as well as variations in gutter height and depth are not necessarily the main criteria for wave gutter design.

Accordingly, the present invention is directed to providing a wave gutter that automatically adjusts itself to maintain an optimum position for wave damping and control of other surface disturbances. The invention includes a relatively stiff, elongate wall member that is hingedly attached to the sidewall of a pool. The wall member pivots about a horizontal axis that is substantially parallel to the side of the pool. The wall member is fabricated so as to be buoyant in water. This buoyancy, together with the wall member's hinged attachment to the sidewall of a pool, allows the gutter of the present invention to maintain an attitude for optimum control of surface disturbances in the pool; that is, with the unhinged longitudinal edge situated proximate the waterline. If desired, the unhinged longitudinal edge may be provided with a tripping lip that adds to the invention's capability for damping surface disturbances.

In the embodiment disclosed, the wave gutter of the present invention is constructed so that it may be removably mounted to the pool wall. Accordingly, mounting apparatus is provided which includes a pair of L-shaped straps, each configured to mount upon the coping of the pool and each having a depending leg that hangs down into the pool along the pool's wall surface. Each depending leg has attached thereto the eye portion of a hinge. Affixed to one longitudinal edge of the wall member of the present invention are hook elements that are adapted to be received by the eye portions mounted to the strap.

With the straps mounted to the coping and upper wall portions of the pool side, the wall member forms a wave gutter that automatically adjusts to the surface of the water contained in the pool.

A number of advantages are achieved by the invention disclosed herein. For example, minor variations of the water level do not substantially detract from the efficiency of the invention to suppress surface disturbances created in the pool. The capability of adjusting automatically to water level variations due to evaporation and the like allow the wave gutter of the present invention to maintain a position for optimum efficiency. One longitudinal edge of the wall member is maintained proximate and in confronting relation to the waterline due to the buoyancy of the member together with its hinged attachment to the pool.

Moreover, use of the present invention obviates the need for expensive and elaborate plumbing and pumping arrangements presently in use with larger pools for optimum wave reduction by fixed gutters, as described above.

In addition, as will be seen, the portability and variable length of this invention permits its use in small, irregularly-shaped home pools so popular today, as well as in the larger, rectangular pools built by schools, municipal facilities, and public and private clubs.

For a better understanding of the present invention, together with other and further features and advantages thereof, reference is had to the following description taken in conjunction with the accompanying drawings, the scope of the invention being pointed out in the claims.

DETAILED DESCRIPTION OF THE INVENTION

Figure 1:
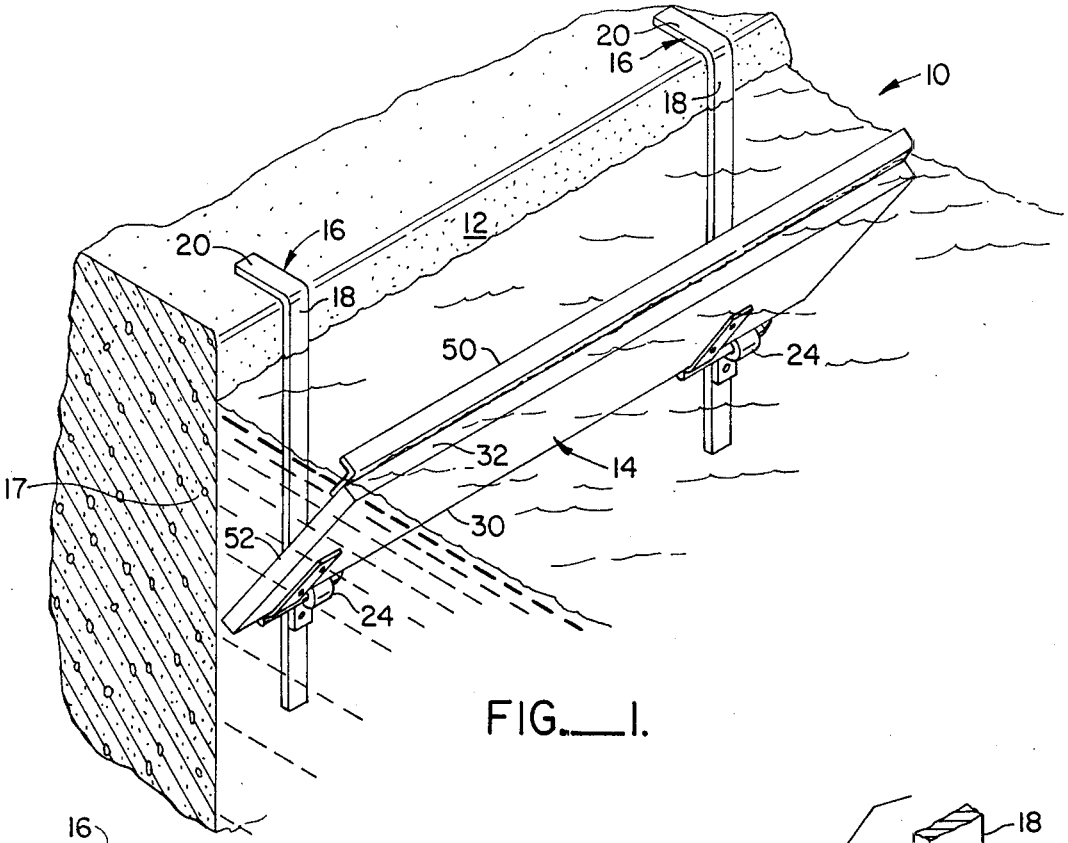
FIG. 1 is a perspective view of the present invention, shown mounted to the wall of a swimming pool, a part of the pool wall being shown in cross-section.

Turning now to the drawings, which illustrate one embodiment of the present invention, there is seen an adjustable wave gutter, generally designated by reference numeral 10, mounted to a portion of a pool wall 12. The wave gutter 10 includes an elongate, rectangularly shaped wall member 14 that is pivotally mounted to a pair of L-shaped mounting straps 16. Each mounting strap has relative perpendicularly oriented legs 18 and 20 to form the L-shape.

The wall member 14 is attached to the straps 16 by a hook-and-eye type hinge 24. This type of hinge is presently contemplated for reasons that will be more fully discussed below. Each hinge 24 includes an eyelet 26, which is mounted to leg 18 of each strap 16, and a hook portion 28 attached to longitudinal edge 30 of wall member 14. The eyelet 26 is affixed to each leg 18 by any appropriate mounting apparatus, such as bolts 32. Similarly, eyelet 28, which includes a pair of spaced confronting hinge leaves 36 affixed to hinge pin 38 (the leaves and pin forming the hook portion of the hinge) are affixed to the wall member 14 using fastening bolts 40. The longitudinal edge 30 of the wall member 14 is sandwiched between the opposing leaves 36 with bolts 40 inserted through appropriately placed holes to fasten and hold each hook portion 28 to the lip member.

If desired, a tripping lip 50 is attached to the wall member 14, proximate the free (unhinged) longitudinal edge 32. In the embodiment shown, the tripping lip 50 is a length of angle iron that is affixed to the upper surface 52 of the wall member. The angle iron is positioned so that one leg 54 thereof lies substantially parallel with the longitudinal edge 32 and extends upward from upper surface 52 of the wall member.

It is presently contemplated that the mounting straps 16, as well as the hinge connections 24 and tripping lip 50, will be fabricated from a non-toxic and substantially non-corrosive material such as stainless steel. Wall member 14 is constructed so that it is buoyant. Accordingly, the wall member is fabricated from wood, such as a clear redwood board with finished surfaces, and provided with a surface coating of epoxy or similar protective material.

The wave gutter 10, constructed as described above, is mounted to the side of a pool by situating straps 16 so that legs 20 rest on the coping of the pool while legs 18 depend downward into the pool, along the pool sidewall 12. Preferably, eyelets 26 are located along legs 18 to place them below the waterline a sufficient distance, when straps 16 are placed on the pool edge, to allow edge 32 of the wall member to be situated by its own buoyancy proximate the waterline—as indicated in the Figures.

Alternately, wall member 14 can be hingedly attached directly to the sidewall of a swimming pool. In this case, appropriately spaced pairs of eyelets 26 are bolted or otherwise connected directly to the pool's sidewall for receiving a wall member 14 having a similarly spaced hook portion 28 pair. It is preferred that the hook portions 28 be attached to the wall member 14 so that their respective hinge plans 38 point in the same direction—as illustrated in FIG. 1. This allows the particular wall member to be easily removed when desired.

It may be that the buoyancy of wall member 14 could cause it, when appropriately mounted to the pool, to float too high. This may require increasing the weight of the wall member to counteract its buoyancy to the correct degree. The tripping lip 50 may add the needed weight. If more is needed, additional weight can be added.

Figure 3A:
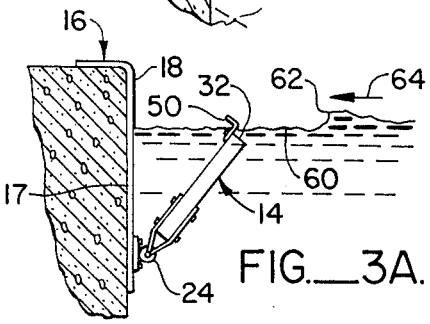
FIGS. 3A–3C are cartoon illustrations of the present invention, illustrating the function of the present invention.
Figure 3B:
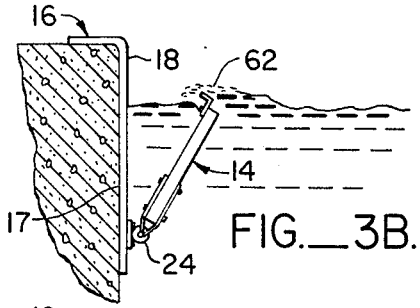
Figure 3C:
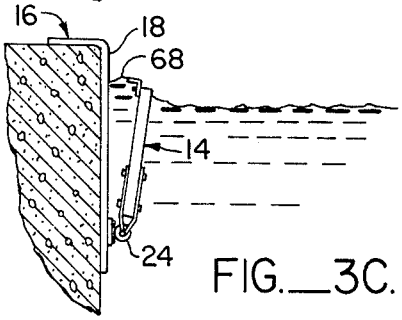
Figure 2:
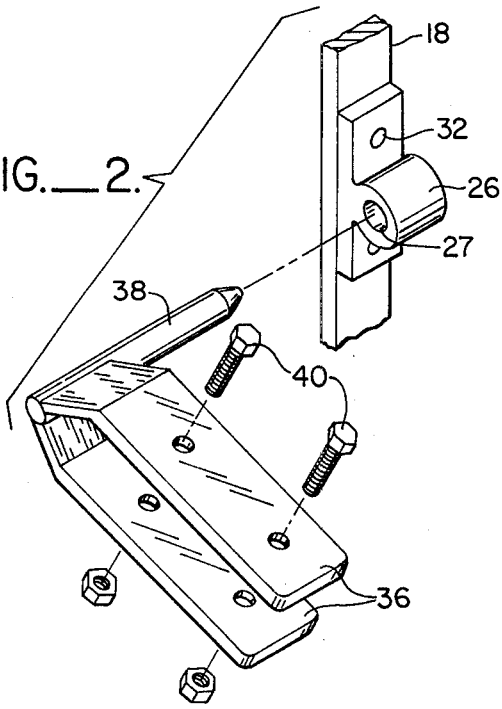
FIG. 2 is an exploded, perspective view of the hinge used to attach the wall member to a sidewall of a pool.

Constructed and attached to a pool coping, as described above, the function of the present invention in dissipating such surface disturbances as waves created in the pool may now be understood with reference to FIGS. 1 and 3A–3C. When the adjustable wave gutter 10 is mounted to the side of the pool and appropriately weighted, the longitudinal edge 32 is positioned proximate the waterline 60 as illustrated in FIG. 3. Assume that a primary wave 62 has been generated in the pool and is traveling in the direction illustrated by arrow 64, toward the wave gutter 10. Assume further that the wavefront of wave 62 is substantially parallel to the pool sidewall 12 and, therefore, wall member 14. This is generally a more atypical case and is discussed first because this type of wave action requires extra energy absorption capability; the reason being that waves with wavefronts traveling toward, and yet parallel to, the wall member apply their energy to the wall member along its full longitudinal edge 32 substantially all at once; whereas oblique wavefronts, which are more typical, impinge upon the wall member in a time-related manner—starting at one end and proceeding to the other end of the wall member. Thus, the (parallel) wave 62 impinges upon the wall member 14, breaking over the longitudinal edge 32 (FIG. 3B). Wave energy is dissipated to a certain extent via this breaking action. However, energy of wave 62 is also absorbed as it works against the inertia of the wall member 14 to pivot it about its hinged connection, toward sidewall 17 (FIG. 3B). If of sufficient magnitude, the primary wave 62 will be reflected by the sidewall 17 to generate secondary wave 68 traveling in the direction indicated by arrow 70 (FIG. 3C). This secondary wave is broken up in the same manner as the primary wave 62; that is, energy is absorbed when the secondary wave 68 impinges upon the wall member and, if large enough, break thereover, as well as working against the inertia of the wall member.

In the more general case, that is when the wavefront of wave 62 forms an oblique angle with wall member 14, energy from the wave is dissipated primarily from the action of the wave breaking over longitudinal edge 32 of the wall member and dissipation of any secondary (reflected) waves—as described above. However, since the (oblique) wavefront impinges upon the wall member, starting at one end and traveling to the other, the energy imposed is usually not sufficient to overcome the inertia of the wall member to cause any appreciable amount of pivoting.

Figure 4:
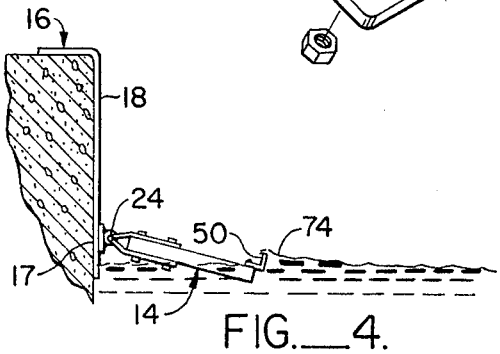
FIG. 4 is an illustration of the function of the invention when the water level of the pool is below the hinge joint.

The present invention also functions to dissipate waves or other surface disturbances when the water level has dropped below the hinge connection 24, as illustrated in FIG. 4. In this situation, the energy of a primary wave 74 will be broken up when it (1) impinges upon the wall member and (2) breaks over the tripping lip 50. Additional energy is absorbed from the wave in overcoming the inertia of the wall member as the wave works to pivot the wall member, as described above.

In this regard, tripping lip 50 performs a threefold function: First, it operates to "stiffen" the longitudinal edge 32 of the wall member 14 which, as will be seen more fully below, enhances the wave-damping capability of the invention. Second, tripping lip 50 dampens secondary disturbances that are reflected from the wall of the pool when the water level is above the hinge 24 connections. Finally, the tripping lip also functions to break up surface disturbances that impinge upon the wall member when the longitudinal edge 32 is positioned below longitudinal edge 30 of the lip member 14. Finally, the tripping lip serves, to a certain extent, as ballast to regulate the buoyancy of the lip member 14 so that the longitudinal edge 32 is positioned substantially at the waterline of the water contained by the pool.

While the above provides a full and complete disclosure of one embodiment of the invention, modifications, alternate constructions and equivalents may be employed without departing from the true spirit and scope of the invention. For example, eyelets 26 of the hinge connections 24 can be slidably affixed to the leg portion 18 of each strap so that the eyelet is relatively adjustable along a longitudinal of leg 18. This would provide additional adjustment to position the longitudinal edge 32 of the wall member 14 substantially at the waterline, wherever that waterline may be.

Therefore, the above description and illustrations should not be construed as limiting the scope of the invention, which is defined by the appended claims.

I claim:

1. Apparatus for forming an adjustable wave-dissipating gutter mounted to a planar, solid vertical side wall of a water-containing pool, the apparatus comprising:

an elongate wall member having a pair of spaced, longitudinal edges, a planar surface formed to extend between the longitudinal edges, and flotation means for allowing the wall member to be buoyant in water;

means attached to one of said longitudinal edge for mounting the wall member to the side wall of the pool and for positioning said longitudinal edges substantially parallel to the pool side wall and to the waterline, a one of said longitudinal edges being positioned relatively outwardly of the other of said longitudinal edges and the pool side wall, the mounting means including means for allowing the wall member to pivot about an axis that is substantially parallel to said longitudinal edges between a first almost vertical position above a horizontal plane containing said axis and a second almost vertical position below said horizontal plane; and a tripping lip attached to the wall member and extending along and in juxtaposed relation with the other said longitudinal edge, the tripping lip extending perpendicularly upwardly from said wall and forming a wall portion that extends perpendicularly away and inwardly from said planar surace of said wall member in a direction toward said pool wall to which said wall member is attached;

whereby, waves generated in the water contained by the pool and reaching the pool side wall are trapped and attenuated between the buoyant member and pool side wall.

2. The wave gutter of claim 1, wherein the flotation means includes fabricating the wall member from a buoyant material.

3. The apparatus of claim 1, wherein the mounting means removably attaches the wall member to the side wall of said pool.

4. The apparatus of claim 1, wherein the mounting means includes at least a pair of L-shaped straps adapted to engage and hang from a coping of said water-containing swimming pool.

* * * * *